United States Patent [19]

Bellicardi et al.

[11] 4,360,164

[45] Nov. 23, 1982

[54] ELECTROMAGNETICALLY ACTUATED FUEL INJECTION VALVE FOR INTERNAL COMBUSTION ENGINES

[75] Inventors: Francesco Bellicardi; Giorgio Zucchi, both of Bologna; Roberto Giusberti, Pianoro, all of Italy

[73] Assignee: Weber Carburatori Azienda della Weber S.p.A., Bologna, Italy

[21] Appl. No.: 197,383

[22] Filed: Oct. 15, 1980

[30] Foreign Application Priority Data

Oct. 19, 1979 [IT] Italy ..... 3515 A/79

[51] Int. Cl.[3] ..... B05B 1/30

[52] U.S. Cl. ..... 239/585

[58] Field of Search ..... 239/585; 251/139–141

[56] References Cited

U.S. PATENT DOCUMENTS 4,007,880 2/1977 Hans et al. ..... 239/585

4,232,830 11/1980 Casey ..... 239/585

FOREIGN PATENT DOCUMENTS 2343285 6/1975 Fed. Rep. of Germany ..... 239/585

*Primary Examiner*—John J. Love

*Assistant Examiner*—Gene A. Church

*Attorney, Agent, or Firm*—Sughrue, Mion, Zinn, Macpeak & Seas

[57] ABSTRACT

An injection valve comprising a hollow casing containing an electromagnetic winding connected to a source of electric pulses, an armature in the casing near the winding, a likewise hollow nozzle held by the casing so as to extend therein for a length defined by the geometrical requirements of the intake manifold so as suitably to position the fuel discharge aperture at the front end of the manifold, a closure means having a first end secured to the armature, an external surface coupled to the inner surface of the nozzle, to guide the travel of the closure means, and a second end comprising a conical part adapted to come in contact with a conical seat formed in the nozzle immediately upstream of a bore and bearing a fuel-atomizing deflector which co-operates with the bore in the nozzle to define the fuel discharge aperture, the conical part forming a seal when, under the action of a resilient force, it is in contact with the conical seat whereas it opens the discharge aperture under the action of the magnetic field so as to allow fuel to escape from the valve, the valve also comprising end-of-travel means adapted to limit the opening travel of the closure means, and a pipe system through which the fuel, after being sent to the valve under pressure by the supply device, travels from the inlet to a region upstream of the sealing seat and between the outer surface of the closure means and the inner surface of the nozzle; said pipe system, at the region upstream of the sealing seat, being formed with a number of bores 37, the axis of which has a considerable component parallel to the central longitudinal axis of the injector.

2 Claims, 3 Drawing Figures

ELECTROMAGNETICALLY ACTUATED FUEL INJECTION VALVE FOR INTERNAL COMBUSTION ENGINES

BACKGROUND OF THE INVENTION

The invention relates to an electromagnetically actuated injection valve of the kind used in electronically controlled injection devices for supplying controlled-ignition engines. More particularly, the invention relates to an injection valve which controls the amount of fuel sent to the engine by opening a constant-section discharge aperture for a given time, which is a fraction of a working cycle of the engine.

Valves of this kind are known.

Valves at present in production pose substantially the following problems:

(1) In order to reduce consumption and pollution, the discharge aperture must be formed in the intake manifold so that the fuel is kept as far as possible away from the walls thereof.

(2) The closure means must have longitudinal dimensions appropriate to the design of the intake manifold but its mass must be at a minimum, in order to reduce the effects of mechanical inertia on the travel time of the closure means.

(3) Friction between the guide surfaces of the closure means must be reduced to a minimum, in order further to reduce the travel times and increase the life of the parts subjected to friction.

(4) The amount of fuel injected per working cycle of the injector must be limited, but only by dimensioning the discharge aperture, so as to eliminate abrupt changes in the trajectory through the supply portion, wich is upstream of the discharge aperture, and also so that the apertures can have relatively small dimensions, since this increases the atomizing effect on the fuel.

(5) It must be possible to construct the injectors industrially at moderate cost and (6) The range of dimensions of the metering parts in series production must be limited, the fuel delivery being metered only by the discharge aperture defined at the end of the nozzle.

SUMMARY OF THE INVENTION

In order to solve these and other problems, the invention provides an injection valve comprising a hollow casing containing an electromagnetic winding connected to a source of electric pulses, an armature in the casing near the winding, a likewise hollow nozzle held by the casing so as to extend therein for a length defined by the geometrical requirements of the intake manifold so as suitably to position the fuel discharge aperture at the front end of the manifold, a closure means having a first end secured to the armature, an external surface coupled to the inner surface of the nozzle to guide the travel of the closure means, and a second end terminating in a conical part adapted to come in contact with a conical seat formed in the nozzle immediately upstream of a bore and bearing a fuel-atomizing deflector which co-operates with the bore in the nozzle to define the fuel discharge aperture, the conical part forming a seal when, under the action of a resilient force, it is held in contact with the conical seat whereas it opens the discharge aperture under the action of the magnetic field so as to allow fuel to escape from the valve, the valve also comprising end-of-travel means adapted to limit the opening travel of the closure means, and a pipe system through which the fuel, after being sent to the valve under pressure by the supply device, travels from the inlet to a region upstream of the sealing seat and between the outer surface of the closure means and the inner surface of the nozzle, said pipe system extending in rectilinear, longitudinal manner through the interior of the closure means and being connected to the region upstream of the sealing seat by a number of bores, whose axis has a large component parallel to the central longitudinal axis of the injector.

In a preferred embodiment of the invention, the spring supplying the force for closing the injector is disposed between an adjustable abutment formed in the fuel pipe system and a region inside the closure means very near the sealing seat.

These and other advantages and features of the invention will be more clearly understood by reference to the accompanying drawings, given by way of non-limitative example of the scope of the present industrial patent.

DESCRIPTION OF A PREFERRED EMBODIMENT

Figure 1:
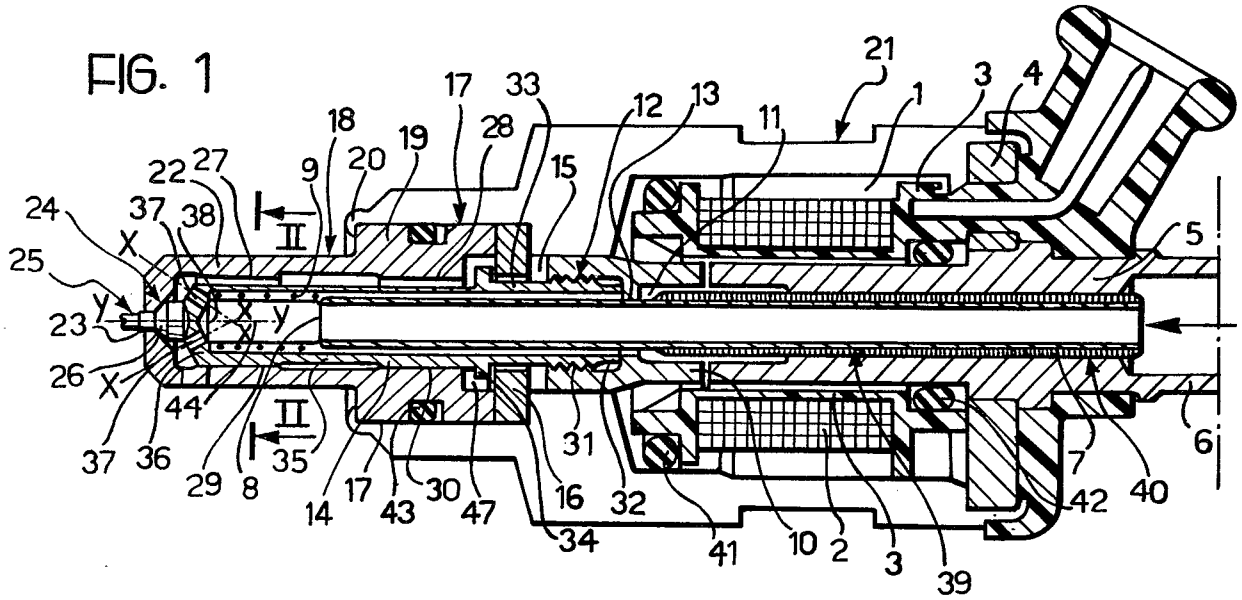
FIG. 1 shows a preferred embodiment of the the invention, in section along a plane of symmetry.

As shown in FIG. 1, an internally hollow metal casing 21 is provided with three recesses 1, 15 and 17 disposed in succession from right to left.

Recess 1 contains a winding 2 which receives electric pulses via two terminals which connect it to the electronic control circuit (not shown) forming part of the pilot circuit of the injection valve. Winding 2 is held by an insulating holder 3 coaxial with the axis of symmetry of the valve.

Recess 1 is closed at the right by a cover 4 having a central bore for inserting a tube 5 into the valve. Tube 5 is made of steel having ferromagnetic properties and serves the following purposes:

(1) By means of a fuel inlet sleeve 6, it connects the valve to the pump and pressure-regulator system (not shown) of the injection device.

(2) It constitutes the magnetic core for the field connected to winding 2, when the winding is energised, and (3) It encloses a through tube 7 which supplies fuel from inlet 6 to a region near the delivery end and has a front part 8 against which a spring 9 abuts.

The recess 1 also contains the right part of armature 10, which is made of iron particularly permeable to the magnetic field and therefore has practically no magnetic hysteresis. Armature 10 has the shape of a solid of revolution, internally hollow, so that tube 7 can extend through it. It is made lighter by a cavity 11 and has a threaded part 12 and an annular wall 13 which defines the limit up to which the right end of closure means 14 can be screwed into the threaded 12. Recess 15 contains almost the entire part 12 of armature 10; it communicates directly with cavity 1 and is bounded at the left by the bore of an annular element 16 made of particularly shock-resistant material.

Recess 17 contains the annular element 16 and bears the right part of the injection nozzle 18 so that the nozzle remains secured to and coaxial with the casing 21 of the injection-valve system.

Nozzle 18 has a substantially cylindrical part 19 adapted to be disposed in recess 17. The edge 20 of casing 21 is bevelled in order mechanically to secure part 19 of nozzle 18 to the recess 17. Part 19 is adapted for suitably positioning the injector in the engine intake manifold (not shown). For this purpose, part 22 can have a considerable length.

The interior of nozzle 22 communicates with the exterior via a bore 23 downstream of a conical seat 24. A deflector 25 forming part of closure means 14 is inserted into bore 23 and regulates the size of the aperture 45 (FIG. 3) for discharging fuel from the interior to the exterior of the injection valve. Deflector 25 is borne by a frusto-conical element 26 which, when pushed by spring 9, forms a seal on seat 24.

The interior of nozzle 18 has two cylindrical surfaces 27, 28 defining the zones bearing and guiding the closure means 14, which in turn has two external zones 29, 30 inside the nozzle 18 which will be described in greater detail hereinafter.

Closure means 14, which is introduced into the cavity of nozzle 18, is also hollow; it is shaped so that fuel can flow in a substantially straight, rectilinear manner towards the outlet end of the valve. The closure means 14 has the following parts. A threaded end 31 adapted to be screwed in the thread 12 of armature 10. It terminates in a cylindrical region 32 which abuts the wall 13 to define the position of closure means 14 relatively to armature 10. An intermediate cylindrical region 33 is contained in the annular element 16 without touching its inner edge. A flange 34 has an outer diameter greater than the inner diameter of annular element 16 so that contact between the left surface of element 16 and the right surface of flange 34 defines the end of opening travel of closure means 14. A prismatic region 35 is provided with guide surfaces 29 and 30 which co-operate with counterfaced guide surfaces 27, 28 of nozzle 18 so as axially go guide the closure means 14. The cross wall 36 has a number of bores 37 and bears the frusto-conical element 26 adapted to co-operate with the frusto-conical surface 24 of nozzle 18 to form a seal, shutting off the flow towards the exterior of the valve. Closure means 14 terminates in a deflector 25 having a throat-like cross-section. Deflector 25, when inserted into bore 23, defines the discharge aperture 45 from the injection valve.

The biasing forces on the closure means 14 towards the right are due to the magnetic field produced by electrical energization of winding 2. The magnetic field attracts armature 10 to the right and consequently attracts the closure means 14 secured thereto, until flange 34 abuts element 16. The biasing forces towards the left are due to spring 9, which is disposed between the annular shoulder 38 of the end wall 36 of closure means 14, and the front part 8 of the through tube 7.

In order to preload spring 9 with the required closing load, tube 7 is appropriately positioned and secured inside tube 5 by punching in zones 39 and 40.

The valve has three annular elements 41, 42 and 43 for sealing the fuel from the exterior and preventing the fuel entering winding 2.

During operation, which consists in alternate opening and closing of means 14, the fuel enters the valve through inlet 6 at a pressure produced by a supply pump and regulated by a pressure regulator (neither of which are shown) in a conventional manner.

Then, the fuel flows through tube 7 into cavity 44 of means 14 and, via bores 37, spreads in the space between the end of nozzle 18 and closure means 14.

The axis X—X of each bore 37 has a component parallel to the axis Y—Y of the closure means 14.

Figure 3:
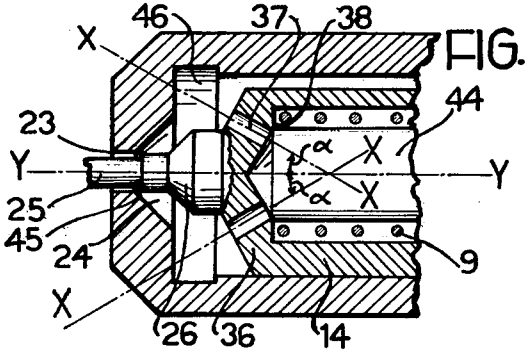
FIG. 3 is an enlarged section view of left side of FIG. 1.

As it may be seen from FIG. 3, each axis X—X of bores 37 intersects the longitudinal axis Y—Y with an angle $\alpha$ which is less than 90°. The fuel travels directly between inlet 6 and bores 37, so as to reduce the pressure drop to a minimum.

When winding 2 is energised and closure means 14 is attracted towards the right, so that the frusto-conical part 26 opens seat 24, the fuel comes out of the annular aperture 45 and is sprayed into the flow of air through the intake manifold, (not shown) in which the valve is inserted. Atomization is facilitated by the shape of deflector 25.

When, on the other hand, winding 2 has been de-energised, spring 9 pushes the frusto-conical part 26 of means 14 to produce a seal, and fuel does not escape from the valve.

The flow rate Q of fuel per unit time through aperture 45 depends on the power delivered. If n represents the engine rotation conditions, the operating frequency f of closure means 14 is proportional to n (generally $f=0.5n$). The period T during which the closure means 14 completes an opening and a closing cycle is the reciprocal of the frequency f. The period T is the sum of four times $\tau_1$, $\tau_2$, $\tau_3$ and $\tau_4$ defined as follows:

$\tau_1$ is the time during which the closure means 14 moves to the right. It begins from the beginning of excitation of winding 2 and lasts until flange 34 abuts element 16. $\tau_1$ depends only on the mechanical and electromagnetic characteristics of the valve.

$\tau_2$ is the time for which means 14 remains in the completely open position. It begins at the end of $\tau_1$ and ends when winding 2 stops being energised. $\tau_2$ depends on the power delivered by the engine.

$\tau_3$ is the time during which the closure means travels to the left under the action of spring 9. It begins at the end of $\tau_2$ and ends when the frusto-conical part 26 abuts seat 24. $\tau_3$ depends on the characteristics of the electromagnetic circuit and the mechanical characteristics of the injector, i.e. the mass of closure means 14, the force of spring 9 and the friction of the guides. It does not depend on the power delivered by the engine.

Finally, $\tau_4$ is the time in which means 14 keeps the discharge aperture 45 closed under the action of spring 9. It begins at the end of $\tau_3$ and lasts as long as winding 2 is not energised. $\tau_4$ depends on the power delivered by the engine.

During the times $\tau_1$, $\tau_2$, $\tau_3$, and $\tau_4$ the amounts of fuel coming out of the discharge aperture 45 are $q_1$, $q_2$, $q_3$ and zero respectively. The flow rate Q delivered per unit time by the injection valve is therefore $Q=f\times(q_1+q_2+q_3)$.

The electronic central unit (not shown) supplies winding 2 during each unit time with a series of pulses $I_1$, thus energising it. Each period T is therefore the sum of the times $T_1$ during which pulses $I_1$ occur and $T_2$ during which the subsequent pauses occur. We therefore have $T=T_1+T_2$, where $T_1$ is the excitation period and $T_2$ is the de-excitation period.

Suppose, for example, that the power delivered by the engine has to be varied without varying its rotation conditions. This means that the fuel delivery Q per unit time has to be varied by varying the duration $T_1$ of pulses $I_1$, without departing from the relation $T=T_1+T_2$.

The time $T_1$ is equal to the sum of the times $\tau_1$ and $\tau_2$ whereas the time $T_2$ is equal to the sum of the times $\tau_3$ and $\tau_4$ as previously defined.

Suppose for simplicity that the amounts of fuel $q_1$, $q_2$ and $q_3$ delivered in times $\tau_1$, $\tau_2$, $\tau_3$ respectively are proportional to the respective times, for a given discharge aperture 45 and a given supply pressure, i.e. an injection device having a given size.

This means that a delivery $Q_1$ is expressed by the relation:

$$Q_1=f\times(K_1\tau_{11}+K_2\tau_{21}+K_3\tau_{31}) \quad (1)$$

If the frequency F is the same, a different value of the delivery Q is obtained from the relation:

$$Q_2=f\times(K_1\tau_{12}+K_2\tau_{22}+K_3\tau_{32}) \quad (2)$$

As we have seen, time $\tau_{11}=\tau_{12}$ and $\tau_{31}=\tau_{32}$, since they depend on the mechanical and electromagnetic characteristics of the valve. As a result, the delivery Q is not proportional to the time $T_1$ during which winding 2 is energised, but an approach can be made to proportionality by reducing the inertia of closure means 14 and friction during operation, so that times $\tau_1$ and $\tau_3$ approach zero.

Similarly, it can be shown that delivery Q is substantially proportional to the product of the frequencies and the times $T_1$ as previously defined, when the engine operates at various speeds, since inertia and friction are reduced to a minimum.

Inertia is reduced to a minimum by reducing the mass of closure means 14. This is particularly facilitated by the valve according to the invention where the closure means 14 has a hollow shape so that almost its entire structure can be made lighter. It may thus have a considerable length without substantially increasing its weight.

Figure 2:
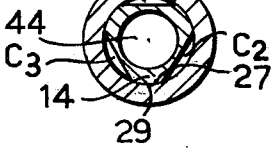
FIG. 2 is a view of the section taken along line II—II of FIG. 1.

Another aspect of the lightness of the closure means 14 is shown in FIG. 2.

As FIG. 2 shows, the portion of means 14 between cross wall 36 and the end-of-travel flange 34 has a prismatic outer surface bounded by a polygon having flat sides alternating with arcs of a circle.

In the illustrated example, this geometrical shape has three flat sides connected by three arcs of a circle. Three ducts $C_1$, $C_2$ and $C_3$ are therefore formed between the outer surface of means 14 and the inner surface of nozzle 18. They connect cavity 46 to cavity 47.

Said ducts, besides increasing the lightness of means 14 reduce the pumping effect of the reciprocating closure means 14 on the fuel and thus reduce friction due to the viscosity of the liquid.

Since the weight of means 14 is reduced by removing material from is centre region, the resulting structure is slender. However, in order to obtain a closure means 14 having a length which is not limited by problems of elastic instability due to the peak load, spring 9 is disposed between shoulder 38 and the front end 8 of tube 7 so that closure means 14 are subjected only to tension, during all the operating periods of the valves.

Finally, the aforementioned positioning of spring 9 reduces friction due to scraping between the guide surfaces 27, 28 and the guide surfaces 29, 30 which slide on them. The reason is that, since the closing force supplied by spring 9 is exerted in a space comprised between the first and second pairs of guide surfaces 27, 29 and 28, 30 the friction occurring during the reciprocating of means 14 is proportional to the aforementioned force.

In fact, should the spring 9 have been operating over the entire length of means 14 and, more particularly, should the spring 9 have been attached at the right side and beyond the guide surface 28, the friction would have been increased by a factor equal to the ratio between the length of means 14 and the distance between the guide surfaces 27 and 28. An increased friction, would have had as a result a reduction of the speed of travel of means 14 and an increase of the times $\tau_1$ and $\tau_3$ as well as the wear on the components coming in contact during motion.

The aforementioned description is of only one out of the possible embodiments of the invention, and the construction can be varied without modifying its essential features.

The shapes, sizes and materials used do not limit the scope of the present invention.

What is claimed is:

1. An injection valve comprising a hollow casing, an electromagnetic winding located in said casing, an axially sliding tubular armature in said casing in close proximity to said winding, a hollow nozzle having an axial bore secured to said casing at one end thereof and axially extending therefrom, an axially sliding closure means located within said hollow nozzle comprising a hollow tubular member secured at one end to said armature with the outer surface thereof disposed in sliding engagement with the inner wall surface of said hollow nozzle, said hollow tubular member being closed at one end by a transverse end wall having an axially extending conical part secured thereto on the outer side thereof, a conical seat disposed in said nozzle surrounding said axial nozzle bore complimentary to said conical part for opening and closing said bore, a fuel atomizing deflector connected to said conical part and extending through said nozzle bore, a fuel supply conduit axially extending through said electromagnetic winding, said tubular armature and said hollow tubular member with one end thereof opening into said hollow tubular member adjacent said transverse end wall, a plurality of bores formed in said end wall of said closure means around said conical part, the longitudinal axis of said bore is being placed at an angle less than 90° with respect to the longitudinal axis of said closure means and spring means disposed between said one end of said fuel supply conduit and said transverse end wall of said closure means.

2. An injection valve as set forth in claim 1, further comprising first and second pairs of counterfaced guide surfaces on the inner surface of said hollow nozzle and the outer surface of said closure means respectively, said first pair of counterfaced guide surfaces being axially spaced from said second pair and said spring means being located within said guide surfaces to exert a force on said transverse end wall in an axial direction opposite to the electromagnetic force exerted by said electromagnetic winding.

* * * * *